US005642611A

United States Patent [19]

Stahlecker

[11] Patent Number: 5,642,611

[45] Date of Patent: Jul. 1, 1997

[54] MOUNTING FOR AN OPENING ROLLER

[75] Inventor: Fritz Stahlecker, Josef-Neidhart-Strasse 18, 73337 Bad Überkingen, Germany

[73] Assignees: Fritz Stahlecker, Bad Überkingen; Hans Stahlecker, Süssen, both of Germany

[21] Appl. No.: 612,821

[22] Filed: Mar. 11, 1996

[30] Foreign Application Priority Data

Mar. 17, 1995 [DE] Germany ..... 195 09 743.2

[51] Int. Cl.[6] ..... D01H 4/00

[52] U.S. Cl. ..... 57/408; 19/97; 19/112

[58] Field of Search ..... 19/97, 112, 113, 19/114; 57/408, 412, 409

[56] References Cited

FOREIGN PATENT DOCUMENTS

3501876A1 7/1986 Germany .

*Primary Examiner*—William Stryjewski

*Attorney, Agent, or Firm*—Evenson McKeown Edwards & Lenahan, PLLC

[57] ABSTRACT

In the case of a mounting for an opening roller comprising a plurality of teeth, all the tooth faces and the tooth backs are inclined in rotational direction. At their tips, the tooth faces form an angle relative to an opening roller radial plane of between 10° and 30° . The tooth backs are more inclined to the radial plane at the tooth tips than at the tooth bases. The tooth backs are inclined at the tooth tips in such a way that an extension of the tangent to the tooth back at the tooth tip intersects the tooth face of the following tooth at an intersecting point which is between one-fifth and four-fifths of the tooth height of the following tooth. At least one-half of a tooth height from the tooth tip to the tooth base has a roller circumferential direction width which is at least as large as the distance between the back of the respective tooth and the face of a next adjacent following tooth.

27 Claims, 3 Drawing Sheets

MOUNTING FOR AN OPENING ROLLER

BACKGROUND AND SUMMARY OF THE INVENTION

The invention relates to a mounting for an opening roller of an open-end spinning machine comprising a plurality of teeth which are arranged, one behind the other, in a plurality of rows extending in circumferential direction, the tooth faces and tooth backs inclined in rotational direction, whereby in the area of the tooth tip, the tooth back is more inclined in relation to the radial plane than at the tooth base, and the tooth face forms an angle between 10° and 30° to the radial.

Usually, opening rollers are provided with a mounting of teeth or needles to comb out fibers from a fed sliver, which fibers are then spun into a yarn. The teeth are usually arranged on the opening roller in a plurality of rows extending in circumferential direction and at a distance to one another, with grooves being formed between the rows. The rows can be arranged in helical fashion, in waves or diagonally in circumferential direction, or in other ways on the circumferential side of the opening roller.

Due to their contour, the teeth are suitable for combing out single fibers from the sliver as soon as the fibers are released from the nipping line of the fiber feeding device. Most of the combed fibers are transported within the grooves formed by the rows of teeth and are brought by the rotating opening roller to a fiber feed channel. Due to the suction present in the fiber feed channel, and to the centrifugal forces created by the opening roller, the fibers are released from the mounting and fed by means of the fiber feed channel to a spinning element.

A mounting for an opening roller is known in U.S. Pat. No. 5 4,646,389. The teeth of the mounting are arranged in circumferential direction, one behind the other, in such a way that a plurality of rows are formed with grooves between the rows. The tooth faces are inclined at an angle between 12° and 30° in rotational direction. The tooth backs are also inclined in rotational direction, whereby the angle of inclination from the tooth tip to the tooth foot diminishes gradually.

The teeth are aggressive enough in this form to comb the fibers out of the sliver, without the re-release of the combed fibers being hindered thereby. The contour of the teeth ensures a good taking-along of the fibers in the grooves formed between the rows of teeth.

It is an object of the present invention to improve the transport of the fibers.

This object has been achieved in accordance with the present invention in that the tooth back is inclined at the tooth tip at an angle to the radial plane, the side of which angle intersects the tooth face of the following tooth at an intersecting point which is at least one fifth of the tooth height away from the tooth tip and from the tooth base.

As a result of the inclination of the tooth back according to the invention, the contour of the tooth, in particular in the area bordering the tooth tip, is altered. The steeper inclination, in contrast to that of the known tooth, leads to an enlargement of the tooth flanks and thus to an increased frictional effect on the fibers inside the grooves. Thus the combed fibers are better transported.

The inclination is, however, on the other hand not that steep that the required aggressiveness of the tooth needed for effective combing out is lost. The steeper inclination of the tooth back does not hinder the release of the transported fibers after they have been combed out. A practical compromise between the technically desired effects of combing out, taking along and releasing of the fibers is maintained.

Under the term "mounting" is understood the entire profiled outer circumferential surface of an opening roller including all elevations and hollows. Included in the mounting are all rows of teeth, grooves, notches and other profiling irrespective of how they are made. It is irrelevant whether the mounting is made, for example, by mounting a saw tooth wire onto a cylindrical circumferential surface or by working the teeth into the material of a cylindrical or hollow cylindrical body.

In an advantageous embodiment of the present invention, the distance between the tooth face and tooth back, that is the width of the tooth flank, is between 0.5 to 1.4 times that of the tooth height. The distance is measured at the start of the second fifth of the tooth height, that is at a point which is a fifth of the tooth height away from the tooth base. In the case of the above mentioned advantageous ratio of tooth width to tooth height, the contour and the size of the tooth flanks are set in such a way that the above mentioned technical effects can be brought about in an improved way.

In a further advantageous feature of preferred embodiments, the teeth are arranged in a spacing which is 0.8 to 1.6 times the height of a tooth. The inclination of the tooth back according to the invention has a positive effect on the taking-along of the fibers, in particular when the ratio of the spacing to the tooth height is relatively small.

In advantageous embodiments, the tooth back graduates at the tooth base through a curve into the tooth face of the following tooth. The curve ensures that the fibers do not land in the area of the tooth base after being combed out. The fibers lying in the grooves located above the tooth bases are taken along in an advantageous way as a result of the tooth form according to the invention.

In a practical embodiment, the distance between the tooth back of one tooth and the tooth face of the following tooth measures 0.6 to 1.2 times the distance between the tooth back and the tooth face of one single tooth. The distances are based on the measurement at the start of the second fifth of the tooth height, measured from the tooth base. The former distances determine the size of the axial notch, located between two teeth, as well as the position of the tooth face relative to the tooth back of the preceding tooth. The resulting form and arrangement of the teeth leads to a further improvement in the taking along of the fibers.

It is advantageous when the angle formed at the tooth tip between the tooth back and the radial plane measures between 35° and 70° .

It is further practical when the angle at the tooth tip formed between the tooth back and the tooth face measures between 25° and 60°

In an advantageous embodiment, the tooth face has a concavely curved section. This construction prevents the fibers all reaching the area of the tooth base after being combed out. This applies in particular when in addition, the tooth back graduates at the tooth base through a curve into the tooth face of the next tooth. As a result of the tooth form according to the present invention, the fibers in the grooves located above the tooth bases are effectively taken along.

In a practical embodiment, the tooth back has a hump, adjacent to which is a section inclined more to the radial plane towards the tooth tip, and a section inclined less no the radial plane towards the tooth base. This construction enables the angle of inclination at the tooth tip to be made sufficiently small so that the combing out effect is not impaired. Thus, in the case of a narrower spacing between the teeth, a sufficiently large tooth surface can be maintained at the tooth flank.

It is advantageous when the section with the large angle of inclination and/or the section with the smaller angle of inclination, extend at least partly straight.

In an advantageous embodiment, the hump comprises a convexly curved section, in which the section with the larger angle of inclination graduates into the section with the smaller angle of inclination.

These and further objects, features and advantages of the present invention will become more readily apparent from the following detailed description thereof when taken in conjunction with the accompanying drawings.

DETAILED DESCRIPTION OF THE DRAWINGS

Figure 1:
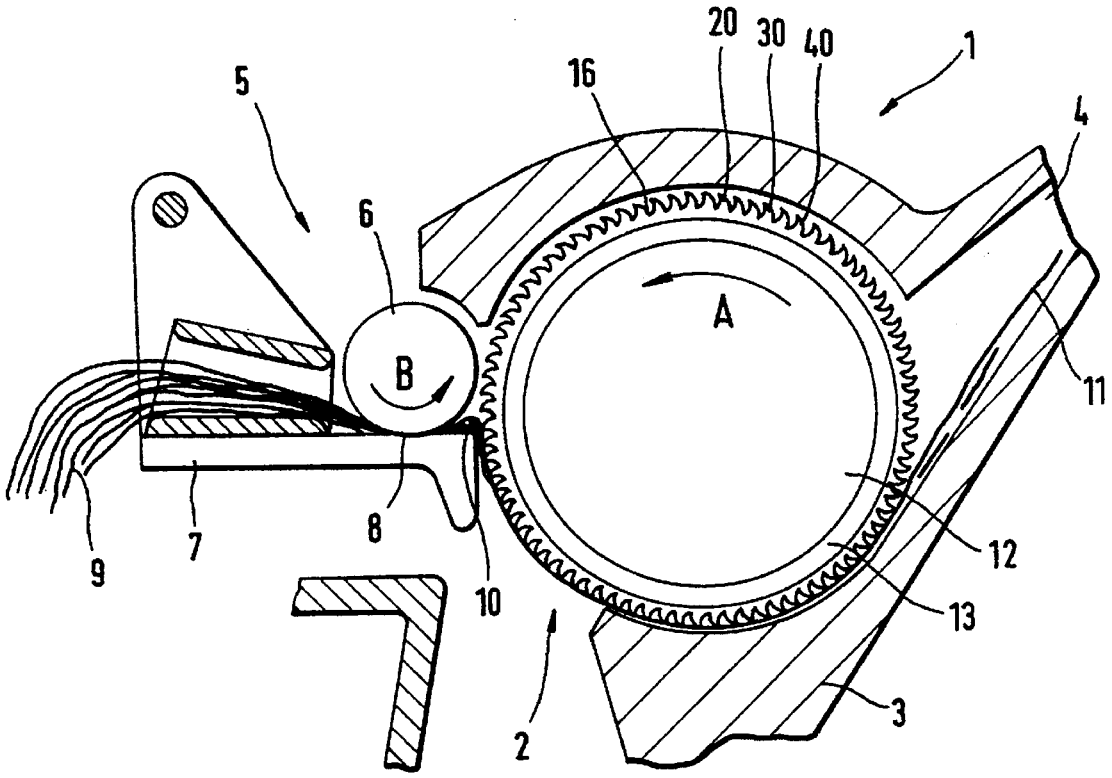
FIG. 1 is an opening device of an open-end spinning apparatus in cross section, including an opening roller constructed according to preferred embodiments of the present invention.

The opening device 1 shown in FIG. 1 comprises essentially an opening roller 2 and an opening roller housing 3, which takes up the opening roller 2, which rotates in rotational direction A.

The opening roller 2 comprises a cylindrical base body 12 and a ring mounting 13 tightly coupled thereto, which carries a mounting 16 with teeth 20,30,40. The entire circumferential side of the ring mounting 13 with all the teeth 20,30,40 and all the surfaces lying between the named teeth 20,30,40 are denoted as being part of the mounting 16.

A feeding device 5 for feeding a sliver 9 is arranged upstream of the opening device 1. The feeding device 5 comprises essentially a feed roller 6, rotating in rotational direction B, and a feed table 7, which together form a nipping line 8 for the sliver 9.

The fibers of the continuously fed sliver 9, held fast at the nipping line 8, are supplied to the opening roller 2 in the form of a fiber beard 10. As a consequence of the rotation of the feed roller 6, single fibers 11 are continuously released from the nipping connection at the nipping line 8 and caught by the opening roller 2. The single fibers 11 are transported from the opening roller 2 in rotational direction A to a fiber feed channel 4, where, owing to the centrifugal forces effected by the opening roller 2, and the suction at the fiber feed channel 4, they are released from the opening roller 2 and transported to a spinning organ such as a spinning rotor (not shown).

Figure 2:
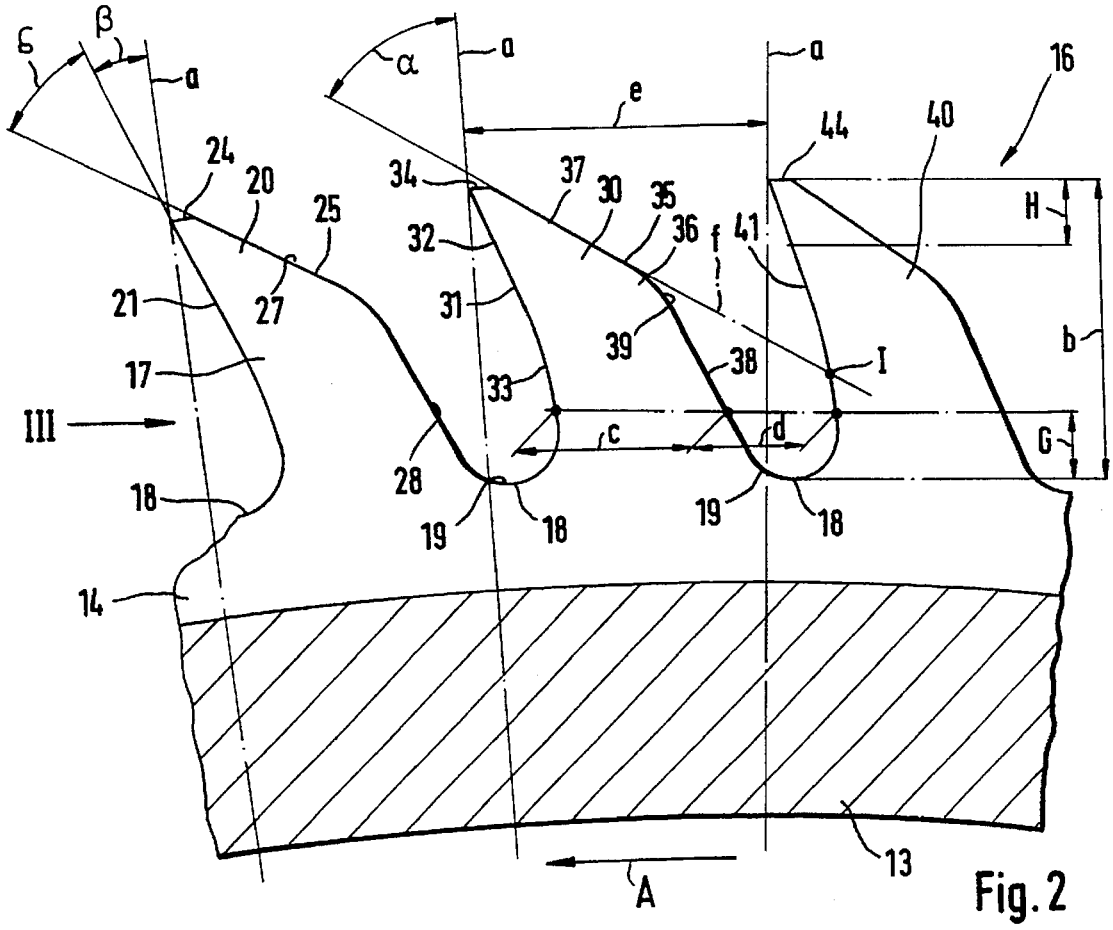
FIG. 2 is a partial sectional view of a mounting for an opening roller of the opening device shown in FIG. 1.

As can be seen from FIG. 2, the teeth 20,30,40, are arranged one behind the other in a row 14 in the circumferential direction of the opening roller 2. The mounting 16 of the ring mounting 13 comprises a plurality of such rows 14 extending in circumferential direction, as well as grooves 15 (see also FIG. 3) which are formed respectively between two neighboring rows 14. The rows 14 and the grooves 15 are arranged in a helically extending winding. The mounting 16, with the rows 14 comprising the teeth 20,30,40 and the grooves 15, is worked or machined from the solid material of the ring mounting 13.

The teeth 20,30,40 as well as all the other teeth (not shown) of the mounting 16 are formed and arranged in the same way. The following descriptions of FIGS. 2 and 3 apply therefore to all the teeth of the mounting 16.

Figure 3:
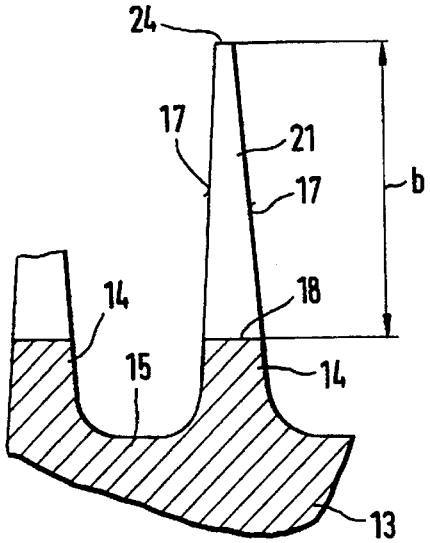
FIG. 3 is a view of a tooth of the mounting shown in FIG. 2, taken in the direction of arrow III in FIG. 2.

As can be seen from FIGS. 2 and 3, the tooth 20 comprises a tooth face 21, a tooth tip 24 and a tooth back 25, which graduates through a tooth base 18 into the following tooth 30. The tooth tip 24 is flattened slightly in circumferential direction.

The line of the tooth face 21, the tooth tip 24 and the tooth back 25 determines the form and the size of the congruently constructed tooth flanks 17, which form the side walls of the tooth 20 and which also extend in circumferential direction. As can be seen from FIG. 3, the tooth 20, as seen in circumferential direction, has a form which tapers towards the tooth tip 24, so that the teeth flanks 17 taper towards each other in the direction of the tooth tip 24.

The tooth face 21 is inclined towards rotational direction A and forms an angle $\beta$ to the radial plane at the tooth tip 24. The tooth back 25, also inclined in rotational direction A, comprises a section 27 adjacent to the tooth tip 24, and a section 28 adjacent to the tooth base 18. The inclination of the section 27 adjacent to the tooth tip 24 towards the radial plane is steeper than the inclination of the section 28 adjacent to the tooth base 18. The section 27 of the tooth back 25 forms an angle $\delta$ with the tooth face 21.

The contour of all the teeth 20,30,40 on the mounting 16 and their arrangement to their respective neighboring teeth is further explained below by way of example with teeth 30 and 40.

As can be seen from FIG. 2, the tooth 30, similarly to tooth 20, comprises a tooth face 31, a tooth tip 34 and a tooth back 35. The tooth face 31 comprises a straight section 32 adjacent to the tooth tip 34, to which section 32 a concavely curved section 33 is adjoined, which section 33 graduates through a curve 19 into the tooth base 18.

The tooth 30 comprises a hump 36 on the tooth back 35, whose outer contour forms a convexly curved section 39. A section 37, more steeply inclined to the radial plane "a", adjoins the convexly curved section 39 in the direction towards the tooth tip 34, while a section 38 which is less steeply inclined adjoins the convexly curved section 39 in the direction towards the tooth base 18. The section 37 and the section 38 both have a straight contour. The more steeply inclined section 37 of the tooth back 35 forms an angle $\alpha$ with the radial plane "a" at the tooth tip The side f of the angle $\alpha$ intersects the tooth face 41 of the following tooth 40 at an intersecting point I. This intersecting point I lies at a defined radial distance from the tooth tip 44 and from the tooth base 18.

In FIGS. 2 and 3 for the purpose of better representation, the radial distance between the tooth tip 44 and the tooth base 18, that is the tooth height, is denoted by b. The radial distance G from the tooth Base 18 and the radial distance H from the tooth tip 44 measure each a fifth of the tooth height b.

The intersecting point I lies more than one fifth of the tooth height b from the tooth tip 44 and from the tooth base 18.

In the embodiment shown in FIG. 2, the tooth height b measures approximately between 2.3 and 2.4 mm. In the radial height G, the distance c between the tooth face 31 and the tooth back 35 of the tooth 30 measures approximately 1.4 mm. The distance d between the tooth back 35 of the tooth 30 and the tooth face 41 of the tooth 40 measures approximately 0.8 mm. The defined spacing e, arising from the distance between the tooth tips 34 and 44 of two neighboring teeth 30 and 40, measures approximately 2.4 mm. The straight section 32 of the tooth face 31 has a length of approximately 0.8 mm. The section 33 of the tooth face 31 is curved in a radius of curvature of approximately 3.5 mm. The curve 19 is curved in a radius of curvature of approximately 0.35 mm. The angle β formed at the tooth tip 34 between the tooth back 35 and the radial plane "a" measures approximately 57° 30'. The angle δ formed at the tooth tip 24 between the tooth face 2i and the radial plane "a" measures approximately 22°. The angle formed at the tooth tip 24 between the tooth face 21 and the tooth back 25 measures approximately 35° 30'. The above mentioned angles and measurements apply to all teeth 20,30,40 of the mounting 16.

As can be seen in FIG. 2, the spacing e is relatively small, while the indentation between the two neighboring teeth 20 and 30 or 30 and 40 is relatively large. The tooth flanks 17 are, however, also relatively large in the areas bordering the tooth tips 24,34,44, so that an effective taking-along of the combed out fibers is ensured. This is achieved as a result of the line of the tooth back 25,35, described above. In addition, a further advantage is maintained in that the areas bordering the tooth tips 24,34,44 are more stable; they do not break or bend so easily.

As in the embodiment described above, the embodiment shown in FIG. 4 also has a plurality of teeth 50,60, which are arranged on a mounting 16 of a ring mounting 13 for an opening roller 2. The tooth face 51 and the tooth back 55 of the tooth 50 are inclined in rotational direction A. The tooth back 55 has a hump 56, adjacent to which is a section 57, inclined more to the radial plane "a" towards the tooth tip 54, and a section 58 inclined less towards the radial plane "a" in the direction of the tooth base 70. The tooth 60 is formed in the same way.

Unlike the embodiment shown in FIG. 2, the tooth face 51,61 is straight. It has no concavely curved section, and graduates from its straight line through a curve 71 into the tooth base 70.

The more steeply inclined section 57 of the tooth back 55 forms an angle ϵ with the radial plane "a" at the tooth tip 54, whose side o intersects the tooth face 61 of the following tooth 60 at an intersecting point N. The intersecting point N lies more than one fifth of the tooth height m from its tooth tip and from its tooth base 70. The relevant fifths of the height m are denoted by the spaces L and K.

Figure 4:
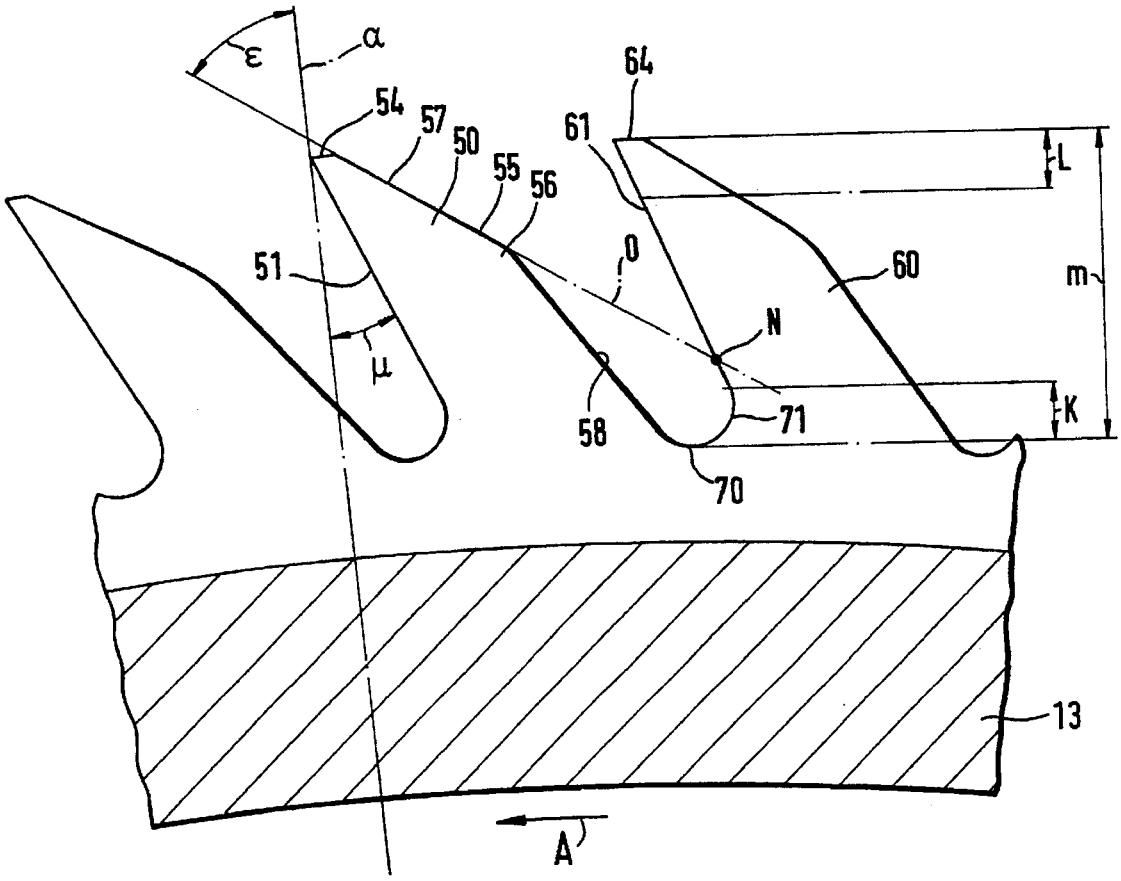
FIG. 4 is a partial view similar to FIG. 2 of another embodiment of a mounting for an opening roller.

In the embodiment shown in FIG. 4, the tooth height m measures approximately 2.4 mm. The spacing between two adjacent teeth 50 and 60 measures also approximately 2.4 mm. The curve 71 is curved in a radius of curvature of approximately 0.35 mm. The angle formed at the tooth tip 54 between the tooth bask 55 and the radial plane "a" measures approximately 57° 30'. The angleμ formed at the tooth tip 54 between the tooth face 51 and the radial plane "a" measures approximately 22°

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A mounting for an opening roller of an open-end spinning machine comprising a plurality of teeth arranged one behind the other in a plurality of rows extending essentially in circumferential direction, wherein tooth faces and tooth backs of the teeth are inclined in rotational direction, the tooth back being more inclined in an area of a tooth tip than at a tooth base, the tooth face forming an angle to a roller radial plane of between 10° and 30°, and wherein the tooth back is inclined at the tooth tip to the radial plane such that an extension of the tangent to the tooth back at the tooth tip intersects the tooth face of a following tooth at an intersecting point which is between one fifth and four fifths of a tooth height from the tooth tip to the tooth base.

2. A mounting according to claim 1, wherein, at the start of a second fifth of the tooth height, measured from the tooth base, a distance between the tooth face and the tooth back of a next adjacent tooth measures 0.5 to 1.4 times the tooth height.

3. A mounting according to claim 2, wherein the teeth are arranged in circumferential direction so that the spacing between the teeth measures between 0.8 and 1.6 times the tooth height.

4. A mounting according to claim 3, wherein the tooth back graduates at the tooth base through a curve into the tooth face of the following tooth.

5. A mounting according to claim 4, wherein, at the start of a second fifth of the tooth height, measured from the tooth base, a distance between the tooth back of a tooth and the tooth face of the following tooth measures between 0.6 and 1.2 times the distance between the tooth back and the tooth face of one single tooth.

6. A mounting according to claim 5, wherein the angle formed at the tooth tip between the tooth back and the radial plane measures between 35° and 70°.

7. A mounting according to claim 5, wherein the angle (δ) formed at the tooth tip between the tooth back and the tooth face measures between 25° and 60°.

8. A mounting according to claim 7, wherein the tooth face comprises a concavely curved section.

9. A mounting according to claim 8, wherein the tooth back comprises a hump, adjacent to which hump is a section which is more inclined relative to the radial plane in the direction of the tooth tip, and also adjacent to which hump is a section less inclined relative to the radial plane in the direction of the tooth base.

10. A mounting according to claim 1, wherein the teeth are arranged in circumferential direction so that the spacing between the teeth measures between 0.8 and 1.6 times the tooth height.

11. A mounting according to claims 1, wherein the tooth back graduates at the tooth base through a curve into the tooth face of the following tooth.

12. A mounting according to claim 1, wherein, at the start of a second fifth of the tooth height, measured from the tooth base, a distance between the tooth back of a tooth and the tooth face of the following tooth measures between 0.6 and 1.2 times the distance between the tooth back and the tooth face of one single tooth.

13. A mounting according to claims 1, wherein the angle formed at the tooth tip between the tooth back and the radial plane measures between 35° and 70°.

14. A mounting according to claims 1, wherein the angle (δ) formed at the tooth tip between the tooth back and the tooth face measures between 25° and 60°.

15. A mounting according to claim 1, wherein the tooth face comprises a concavely curved section.

16. A mounting according to claim 1, wherein the tooth back comprises a hump, adjacent to which hump is a section which is more inclined relative no the radial plane in the direction of the tooth tip, and also adjacent to which hump is a section less inclined relative to the radial plane in the direction of the tooth base.

17. A mounting according to claim 16, wherein the at least one of more inclined section and the less inclined section extend at least partly straight.

18. A mounting according to claim 17, wherein the hump comprises a convexly curved section, at which the more steeply inclined section graduates into the less steeply inclined section.

19. A mounting according to claim 16, wherein the hump comprises a convexly curved section, at which the more steeply inclined section graduates into the less steeply inclined section.

20. A mounting for an opening roller of an open-end spinning machine comprising a plurality of teeth arranged one behind the other in a plurality of rows extending essentially in circumferential direction, wherein tooth faces and tooth backs of the teeth are inclined in rotational direction, the tooth back being more inclined in an area of a tooth tip than at a tooth base, the tooth face forming an angle to a radial plane of between 10° and 30°, and wherein at least one-half of a tooth height from the tooth tip to the tooth base has a roller circumferential direction width which is at least as large as the distance between the back of the respective tooth and the face of a next adjacent following tooth.

21. A mounting according to claim 20, wherein the tooth back graduates at the tooth base through a curve into the tooth face of the following tooth.

22. A mounting according to claim 20, wherein the angle formed at the tooth tip between the tooth back and the radial plane measures between 35° and 70°.

23. A mounting according to claim 20, wherein the angle formed at the tooth tip between the tooth back and the tooth face measures between 25° and 60°.

24. A mounting according to claim 20, wherein the tooth face comprises a concavely curved section.

25. A mounting according to claim 20, wherein the tooth back comprises a hump, adjacent to which hump is a section which is more inclined relative to the radial plane in the direction of the tooth tip, and also adjacent to which hump is a section less inclined relative to the radial plane in the direction of the tooth base.

26. A mounting according to claim 25, wherein the at least one more inclined section and or the less inclined section extend at least partly straight.

27. A mounting according to claim 26, wherein the hump comprises a convexly curved section, at which the more steeply inclined section graduates into the less steeply inclined section.

* * * * *